US006672084B2

(12) United States Patent
Cho et al.

(10) Patent No.: US 6,672,084 B2
(45) Date of Patent: Jan. 6, 2004

(54) ENERGY SAVING REFRIGERATION SYSTEM USING COMPOSITION CONTROL WITH MIXED REFRIGERANTS

(75) Inventors: Young I. Cho, Cherry Hill, NJ (US); Cheolho Bai, Taegu (KR)

(73) Assignee: Vai Holdings, LLC, Cherry Hill, NJ (US)

( * ) Notice: Subject to any disclaimer, the term of this patent is extended or adjusted under 35 U.S.C. 154(b) by 0 days.

(21) Appl. No.: 10/189,950

(22) Filed: Jul. 3, 2002

(65) Prior Publication Data

US 2003/0051489 A1 Mar. 20, 2003

Related U.S. Application Data

(60) Provisional application No. 60/303,198, filed on Jul. 5, 2001.

(51) Int. Cl.[7] ..... F25B 1/00; C04B 35/04

(52) U.S. Cl. ..... 62/114; 62/502

(58) Field of Search ..... 62/114, 117, 122, 62/190, 196.1, 474, 498, 502, 512, 529; 252/67

(56) References Cited

U.S. PATENT DOCUMENTS 5,551,249 A * 9/1996 Van Steenburgh, Jr. .... 62/196.4
5,709,090 A * 1/1998 Endo et al. ..... 62/81
6,293,108 B1 * 9/2001 Cho et al. ..... 62/5

* cited by examiner

*Primary Examiner*—Henry Bennett
*Assistant Examiner*—Malik N. Drake
(74) *Attorney, Agent, or Firm*—Ostrolenk, Faber, Gerb & Soffen, LLP

(57) ABSTRACT

An energy-saving refrigeration system circulates a mixture of R-134a, R-32 and R-125 whose composition is controlled using a vapor separator. A vortex generator is a preferred means to separate the mixture. For high thermal load operation, R-32 stays in the circulating line with increased cooling capacity, and R-134a and R-125 are stored in a storage tank. Conversely, for low thermal load operation, R-134a and R-125 stay in the circulating line with increased EER, and R-32 is stored in a storage tank. Multiple storage tanks can be used to control the composition of each refrigerant independently.

39 Claims, 8 Drawing Sheets

ENERGY SAVING REFRIGERATION SYSTEM USING COMPOSITION CONTROL WITH MIXED REFRIGERANTS

CROSS REFERENCE TO RELATED APPLICATION

This application is based on and claims benefit of U.S. Provisional Patent Application No. 60/303,198 filed Jul. 5, 2001 entitled ENERGY SAVING REFRIGERATION SYSTEM USING COMPOSITION CONTROL WITH MIXED REFRIGERANTS, the disclosure of which is hereby incorporated by reference and to which a claim of priority is hereby made.

FIELD OF THE INVENTION

This invention relates to refrigeration apparatus and a refrigeration process and a process employing a mixture of different refrigerants.

BACKGROUND OF THE INVENTION

Refrigeration systems are well known which employ a single refrigerant, for example, CFC refrigerants such as R-12 and HCFC refrigerants such as R-22. These refrigerants, however, have serious environmental drawbacks and are being replaced by refrigerants of the HFC type such as R-32, R-125 and R-134a in different combinations.

The individual HFC refrigerants have diverse characteristics, as shown in the following table:

| | DENSITY | BOILING POINT | LATENT HEAT ($h_{fg}$) | CONDENSER PRESSURE | EVAPORATOR PRESSURE | HEAT TRANSFER CHARACT. | FLAM-ABILITY |
|---|---|---|---|---|---|---|---|
| R-32 | Light | Low | Large | High | High | Good | Yes |
| R-125 | Heavy | Low | Small | High | High | Medium | No |
| R-134a | Medium | High | Medium | Low | Low | Poor | No |

In many refrigeration systems, the following characteristics are preferred:

Density—heavy

Boiling Point—low at evaporator and high at condenser

Latent Heat—large

Condenser Pressure—low

Evaporator Pressure—high

Heat Transfer—good

Flammability—no

In the above, $h_{fg}$ is the enthalpy difference between 100% vapor and 100% liquid.

R-32 is a preferred refrigerant because of its high latent heat and high evaporator pressure, which reduces the compressor work and thus the compressor size. That is, the compressor work $W_{COMPRESSOR}$ is defined as:

$$W_{COMPRESSOR}=\int vdP$$

where v=specific volume=1/density; and P=pressure.

The compressor work in a typical refrigeration system can be simplified for an isentropic process as:

$$W=\frac{kRT_1}{k-1}\left[\left(\frac{P_2}{P_1}\right)^{(k-1)/k}-1\right]$$

where k is a specific heat ratio, R is a gas constant, and T is temperature. As depicted in the above equation, the compressor work can be reduced by reducing the pressure differential, $P_2-P_1$ or compression ratio, $P_2/P_1$. As the compressor work is reduced, the EER (energy-efficiency ratio) increases because EER is defined as the ratio of the heat absorption at the evaporator to compressor work.

$$EER=\frac{\text{Heat absorption from evaporator}}{\text{Work done by compressor}}$$

In a typical system, as evaporator pressure increases, the pressure change in the compressor is reduced, thus reducing the compressor work.

While R-32 has the best thermal characteristics, it is more flammable than the others, and carries with it the danger of fire. Consequently, R-32 is commonly mixed with non-flammable fluids such as R-125 and R-134a to reduce the fire danger.

Currently available mixture refrigerants include R-407c and R-410a. The former (R-407c) is one of the R-407 series refrigerants, which include R-407a, R-407b, R-407c, etc. The R-407 series is made of three refrigerants R-32, R-125 and R-134a. The last letter in the designation of R-407 indicates different composition ratios of R-32, R-125 and R-134a. For example, R-407c is made of R-32, R-125 and R-134a at a ratio of 23:25:52 based on mass. Similarly, R-410a is one of the R-410 series refrigerants, which are made of two refrigerants R-32 and R-125. The last letter "a" in R-410a indicates that a composition ratio of R-32 and R-125 is 50:50 by mass. Depending on the composition ratio, the last letter can vary.

Several new HFC type refrigerants such as R-134a, R-407c and R-410a have been developed as attempts to optimize the trade-off of flammability versus thermal efficiency. The first R-134a has replaced R-12 for automotive air conditioners, refrigerators and large chillers. This refrigerant has relatively poor heat transfer characteristics but in a typical system produces a pressure of about 8 atm at the evaporator and 16 atm at the condenser. Thus, the relatively small ΔP at the compressor produces excellent efficiency. Therefore, this refrigerant has replaced R-12 for many applications, despite its poor heat transfer characteristics.

A second HFC type refrigerant is R-407c, which is a mixture of R-32, R-125 and R-134a in proportions of 23:25:52 respectively. This mixture, however, produces only about 6 atm at the evaporator and 20 atm at the condenser (like R-22) and has poor heat transfer characteristics due to the high proportion of R-134a.

A third HFC type refrigerant is R-410a, which is a mixture of R-32 and R-125 in a ratio of 50:50 respectively. This mixture, however, produces about 12 atm at the evaporator, but 30 atm at the condenser and requires a large compressor and compressor work.

It would be very desirable to provide a novel refrigeration system, which would permit the use of an non-flammable mixture of refrigerants, a reduced condenser pressure and an increased evaporator pressure; and which takes the best advantage of the properties of the individual fluids of the mixture.

BRIEF DESCRIPTION OF THE INVENTION

In accordance with the invention, a novel system and refrigeration process is provided in which the composition of the refrigerants is controlled as the thermal load of the refrigeration system changes with the help of a vortex generator and a storage tank. For example, for the case of R-407c, the density of R-32 is substantially smaller than those of R-125 and R-134a such that R-32 is separated from the R-125 and R-134a using the centrifugal force in the vortex generator. Once R-32 is separated, it can be stored in a storage tank for the low-thermal load operation. In the low thermal load operation, one can take benefits of the preponderance of R-134a, which is low condenser pressure and high EER (energy-efficiency ratio). For the case of a high thermal load operation, R-125 and R-134a, instead of R-32, can be stored in the storage tank such that one can take benefits from the preponderance of R-32 in the system, which is a high cooling capacity.

Co-pending application Ser. No. 09/608,656 filed Jun. 30, 2000 (P/3746-2) describes a novel system and refrigeration process in which a first component (for example, R-134a) is recirculated in the condenser while the other component or components (for example, R-32 and R-125) are directed, without recirculation, to the evaporator to increase evaporator pressure and heat capacity. The component of the circulating refrigerant may be controlled, as by a valve, in the recirculation path to effectively control thermal load variation.

According to a first aspect of the present invention, there is provided a refrigeration system comprising a compressor, a plurality of condensers, positioned in parallel, each having an input and an output, an expansion device, an evaporator, said compressor, said condensers, said expansion device, and said evaporator being connected in a closed circuit and being operative to circulate a refrigerant fluid comprised of a first component having a first density and a second component having a second density, a separator having an input connected to an output of said compressor and outputs connected to the inputs of said condensers, a storage tank, a plurality of first valves selectively connecting the outputs of the condensers as inputs to the storage tank, and a second valve operative to selectively feed the contents of the storage tank into the closed circuit.

According to a second aspect of the invention, there is provided a refrigeration system comprising fluid compressor means, a plurality of fluid condenser means, positioned in parallel, each having an input and an output, fluid expansion means, evaporator means, said compressor means, said condenser means, said expansion means, and said evaporator means being connected in a closed circuit and being operative to circulate a refrigerant fluid comprised of a first component having a first density and a second component having a second density, fluid separator means having an input connected to an output of said compressor means and outputs connected to the inputs of said condenser means, fluid storage means, a plurality of first valve means selectively connecting the outputs of the condenser means as inputs to the storage means, and second valve means operative to selectively feed the contents of the storage means into the closed circuit.

In a preferred embodiment of the present invention, a vortex generator is used as the means to separate one refrigerant from the other refrigerants. The vortex generator is located between a compressor and condenser. The condenser is divided into two parallel sections. The vortex generator has two outlets, each outlet is connected to the inlet of each condenser such that the light refrigerant (i.e., R-32) enters the condenser-1, whereas the heavy refrigerant (s) enter(s) the condenser-2. Using two three-way valves, the liquid refrigerants from the two condensers can be either stored in the storage tank or sent to an expansion valve.

Once the control of the composition of the mixed refrigerants is completed depending on the high or low thermal load condition, the superheated refrigerant vapor from the compressor bypasses the vortex generator using a three-way valve, and the refrigeration continuously operates with substantial energy savings.

1. The vortex generator, or the like, between compressor and condenser sections will separate R-32 from R-125 and R-134a using the centrifugal force produced by the vortex flow;

2. A three-way valve located at the end of each condenser directs the liquid refrigerant to either the storage tank or the expansion valve, depending on the high or low thermal load;

3. Once the desired composition of the refrigerant mixture is obtained, both the vortex generator and storage tank are isolated (or bypassed) from the operation of the refrigerant system until the changes in thermal load require a new composition of the refrigerants.

In the novel system, the separation of refrigerants is performed using the centrifugal force created by the vortex flow. Other devices that can generate the centrifugal force can be used, including a cyclone.

The advantages produced by the invention include:

1. The use of an non-flammable fluid;

2. A large heat capacity at evaporator;

3. A lower condenser pressure;

4. A higher vapor pressure in the evaporator, producing a lower specific volume v in the evaporator, thus reducing compressor work $\int vdP$.

As a result of the above, the system requires lower compressor work to reduce compressor size, and produces higher latent heat in the evaporator, producing a more efficient evaporator. Furthermore, the refrigeration system in the invention replaces the usual ON/OFF operation of the compressor with the composition control of the mixture refrigerants, thus substantially reducing the energy loss due to the ON/OFF operation. Also, the refrigeration system in the invention eliminates the need of an expensive invertor compressor and associated loss in the EER. The refrigeration system in the invention can produce substantial energy savings and increase SEER (system EER) with the composition control using a constant-speed compressor.

DETAILED DESCRIPTION OF THE DRAWINGS

Refrigeration systems are well known and systems using vortex generator arrangements for improving the efficiency of the system are shown in our recent U.S. Pat. No. 6,250,086 and co-pending application Ser. Nos. 09/535,126 (filed Mar. 28, 2000), 09/737,016 (filed Dec. 14, 2000), 09/760,232 (filed Jan. 14, 2001), and 09/802,763 (filed Mar. 8, 2001), the contents of which are included herein by reference.

The coefficient of performance ("COP") of a refrigeration system, sometimes termed the energy-efficiency ratio (EER), equals $Q_v/W_c$, where $Q_v$ is the heat absorption by the evaporator of the system and $W_c$ is the work done by the compressor. Thus, any system, which decreases $W_c$ and increases $Q_v$, will increase COP and EER. A similar terminology, SEER (system energy-efficiency ratio) is often used to evaluate the efficiency of a refrigeration system over a cooling period, which includes the effect of ON/OFF operation of the compressor on the efficiency of the system. SEER is defined as the ratio of the sum of $Q_v$ times the hours of operation to the sum of $W_c$ times the hours of operation.

Figure 1:
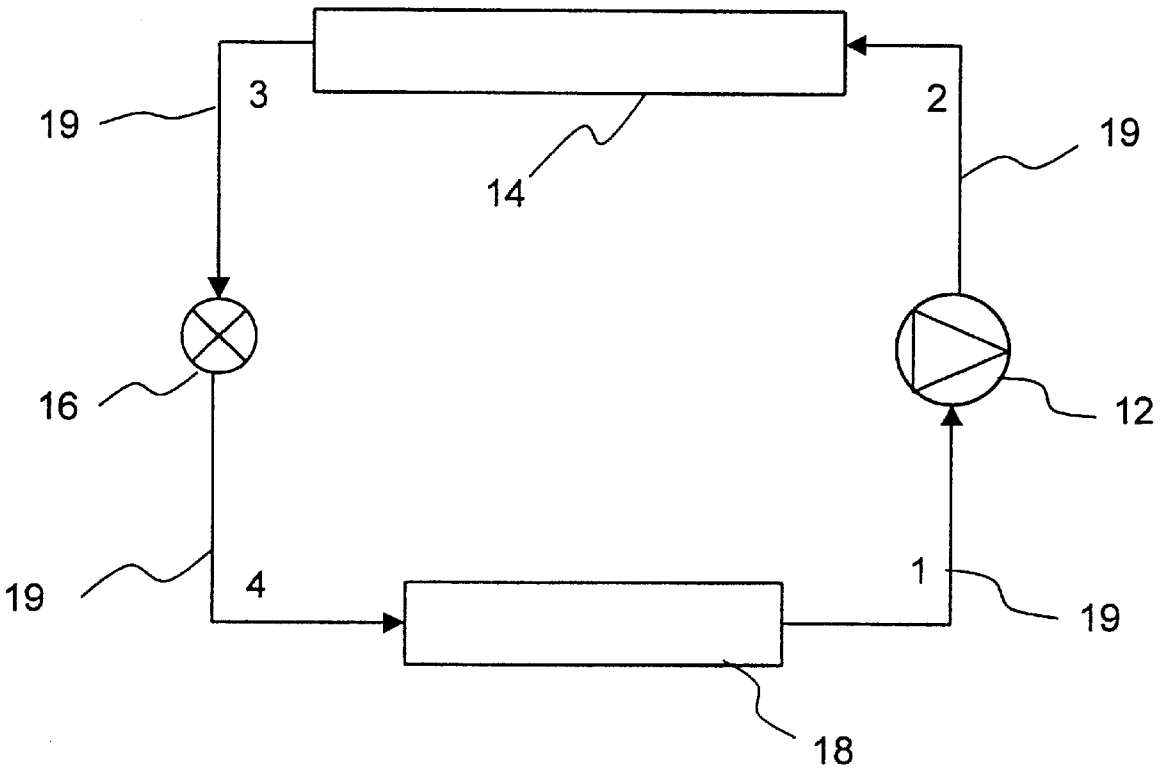
PRIOR ART Fig. 1
FIG. 1 shows a known type of refrigeration system, which may employ a single refrigerant, or a mixture of refrigerants.
Figure 2:
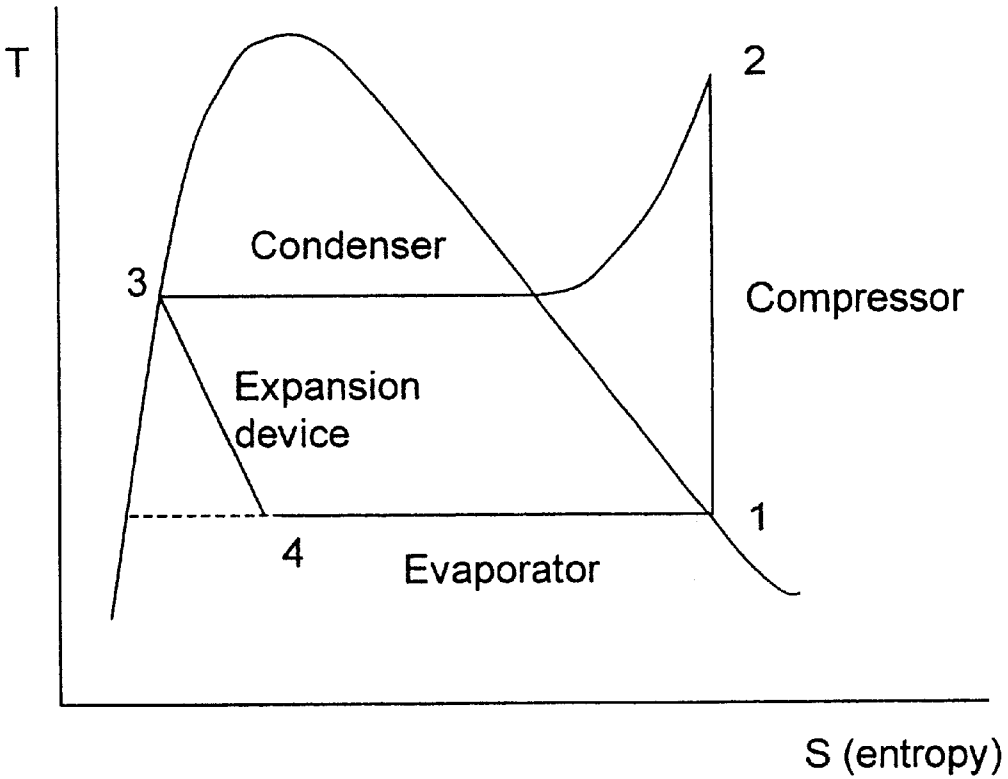
PRIOR ART Fig. 2
FIG. 2 is a temperature-entropy curve of the refrigeration system of FIG. 1.

To illustrate the basic concept of the refrigeration system, FIG. 1 shows a diagram of a refrigeration system and FIG. 2 shows a temperature-entropy diagram of the refrigeration system.

The refrigeration system shown in FIG. 1 includes a compressor 12, a condenser 14, an expansion device 16 and an evaporator 18. The various components are connected together via copper tubing 19.

The refrigeration system is a closed loop system that circulates a refrigerant through the various elements. Some commonly used types of refrigerant include R-12, R-22, R-134a, R-410a, ammonia, carbon dioxide and natural gas. A refrigerant is continuously cycled through the refrigeration system. The main steps in the refrigeration cycle are compression of the refrigerant by the compressor, heat rejection of the refrigerant in the condenser, sudden expansion (i.e., throttling) of the liquid-phase refrigerant in the expansion device, and heat absorption by the refrigerant in the evaporator. As indicated previously, this process is referred to as the vapor compression refrigeration cycle.

The temperature-entropy curve of a typical refrigeration cycle is illustrated in FIG. 2. Point 2 is where the refrigerant exists as a superheated vapor. As heat transfer to the ambient air continues in the condenser 14, the refrigerant becomes a saturated liquid at point 3. After going through the expansion device 16, the refrigerant becomes a mixture of vapor and liquid refrigerants at point 4. As the refrigerant absorbs heat in the evaporator 18, the refrigerant becomes a saturated or slightly superheated vapor at the suction pressure at point 1. These points are also indicated on FIG. 1.

As previously stated, the efficiency of a refrigeration cycle (and by analogy a heat pump cycle) depends primarily on the heat absorption from the evaporator 18 and the work of the compressor 12. The compressor work depends on the difference between the head and suction pressures of compressor 12. The pressure of the refrigerant as it enters the compressor 12 is referred to as the "suction pressure level" and the pressure of the refrigerant as it leaves the compressor 12 is referred to as the "head pressure level". Depending on the type of refrigerant used, the head pressure can range from about 170 PSIG (12 atm) to about 450 PSIG (30 atm).

Compression ratio is the term used to express the pressure difference between the head pressure and the suction pressure. Compression ratio is calculated by converting the head pressure and the suction pressure onto an absolute pressure scale and dividing the head pressure by the suction pressure. When the compression ratio increases, the compressor efficiency drops thereby increasing energy consumption. In most cases, the energy is used by the electric motor that drives the compressor. In addition, when compression ratio increases, the temperature of the refrigerant vapor increases to the point that oil for lubrication may be overheated which may cause corrosion in the refrigeration system.

When a compressor such as compressor 12 runs at a high compression ratio, it no longer has the capability to keep a refrigerated space or living space at the designated temperature. As the compressor efficiency drops, more electricity is used for less refrigeration. Furthermore, running the compressor at a high compression ratio increases the wear and tear on the compressor and decreases its operating life.

An evaporator such as evaporator 18 is made of a long coil or a series of heat transfer panels, which absorb heat from a volume of air that is desired to be cooled. In order to absorb heat from this ambient volume, the temperature of the refrigerant must be lower than that of the volume. The refrigerant exiting the expansion device 16 consists of low quality vapor, which is approximately 20% vapor and 80% liquid.

The liquid portion of the refrigerant is used to absorb heat from the desired volume as the liquid refrigerant evaporates inside the evaporator 18. The vapor portion of the refrigerant is not utilized to absorb heat from the ambient volume. In other words, the vapor portion of the refrigerant does not contribute to cooling the ambient volume and decreases the efficiency of the refrigeration cycle.

Figure 3:
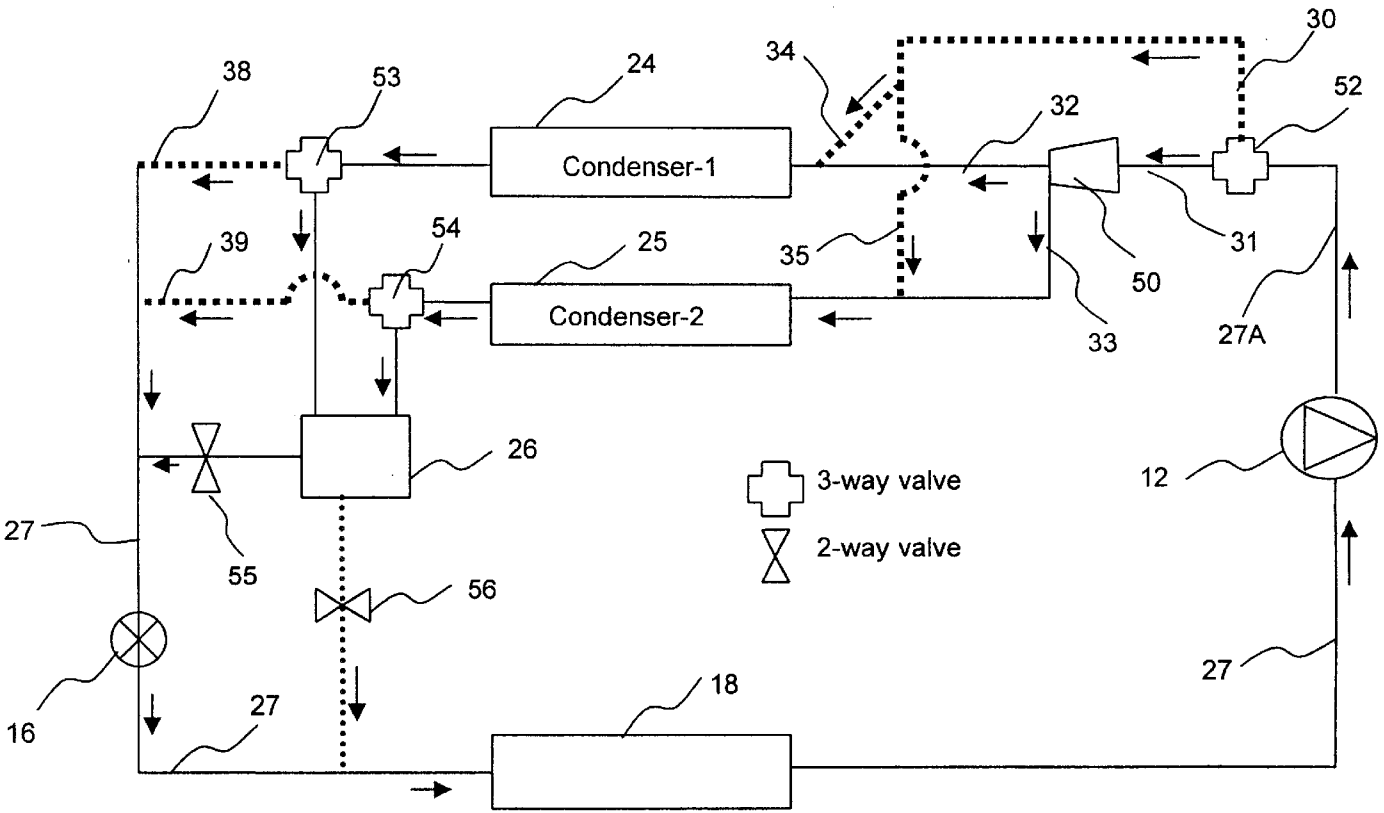
FIG. 3 shows an embodiment of the novel refrigeration system of the invention.
Figure 4:
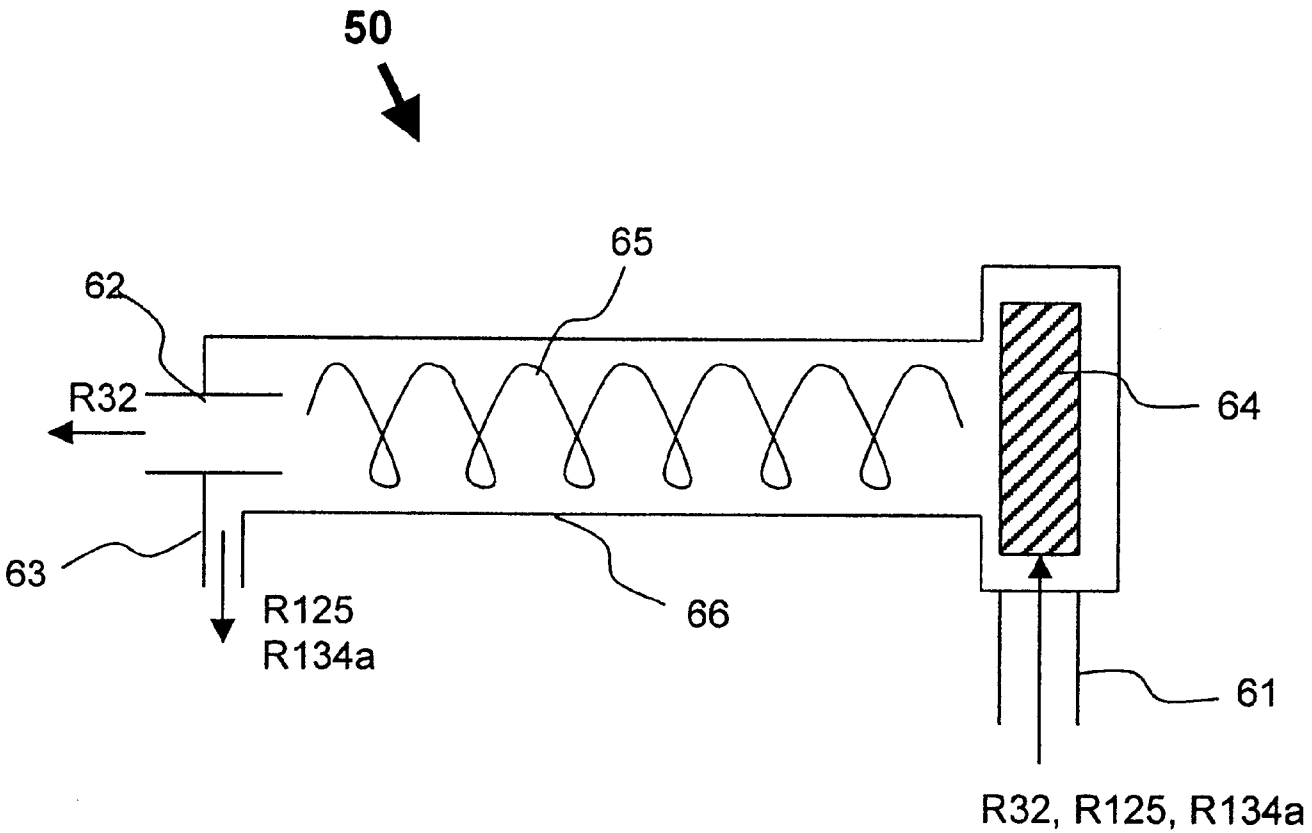
FIG. 4 shows an embodiment of the vortex generator applied in the novel system of the invention.

FIG. 3 shows the novel concept of the invention. A vortex generator 50 is placed between the compressor 12 and condensers 24 and 25. The purpose of the vortex generator is to separate R-32 from R-125 and R-134a using the centrifugal force, which is created by the rotating motion inside a vortex generator. The vortex generator will have two outlets as shown in FIG. 4. One outlet 62 located at the center of the vortex generator has mostly R-32, whereas the other outlet 63 located on the longitudinal circular tube wall 66 of the vortex generator has mostly R-125 and R-134a. The relative densities of the refrigerants allow this separation. Vapor densities of R-125, R-134a and R-32 at a typical compressor head pressure (i.e., 20 atm) are 141.3, 107.6, and 57.1 kg/m$^3$, respectively. Due to significant density differences between R-32 and the other two, the centrifugal force created by the rotating flow throws both R-125 and R-134a toward the vortex generator wall, thus forcing them to leave through the outlet 63, while R-32 remains at the core of the vortex generator tube, leaving through the center outlet 62.

The variables involved in the separation of R-32 from the other two refrigerants can be divided into two groups: those related to inlet flow and those related to VORTEX GENERATOR geometry. The former includes inlet pressure and flow rate, whereas the latter includes nozzle size, the length and diameter of VORTEX GENERATOR. In particular, the length of the vortex generator appears to be critical since if the length is too long, the mixing of the separated vapor can be re-mixed, resulting in no separation.

Returning to FIG. 3, the invention uses a vortex generator 50, two condensers 24 and 25, three 3-way valves 52, 53, 54, two 2-way valves 55 and 56, a storage tank 26, and a by-pass line 30. The whole concept is to vary the composition of the mixed refrigerants depending on the thermal load without turning ON and OFF the compressor. During the high thermal load operation, it is desired to have more R-32 in the system and less R-134a. Hence, when there is a high thermal load, the invention stores R-125 and R-134a at the storage tank by using the vortex generator with help of 3-way valves.

In order to prepare the high thermal load operation, the 2-way valve 55 is opened to allow the refrigerant in the storage tank to leave the tank. The superheated mixture vapor at 27A enters the vortex generator through 3-way valve 52. R-32 exits the vortex generator through the center outlet 62 to condenser 24 via line 32, whereas both R-125 and R-134a exit through the side outlet 63 to condenser 25 via line 33. The 3-way valve 54 sends both R-125 and R-134a to the storage tank 26, pushing the liquid refrigerant from the previous runs out of the storage tank. After a short period (i.e., 5–10 seconds), the 2-way valve 55 is closed, and both R-125 and R-134a begin to be accumulated in the storage tank 26. Consequently, the refrigerant in the system line 27 has more R-32 and less R-125 and R-134a, and hence the cooling capacity at the evaporator 18 increases, meeting the high thermal load operation. Once the new composition of the mixed refrigerant is achieved, the superheated vapor at 27A is directed to the by-pass line 30 (dotted line) with the help of the 3-way valve 52. The superheated vapor enters condensers 24 and 25 through the by-pass lines 34 and 35, respectively. The liquid refrigerant coming out of the condensers 24 and 25 move to the expansion valve 16 via lines 38 and 39 with the help of 3-way valves 53 and 54, respectively. The normal composition ratios for R-407c (a mixture of R-32, R-125 and R-134a) are 23:25:52% by weight. The new composition ratio in the invention for the high thermal load operation, for example, is 70:10:20% by weight for the high thermal load operation. In case that R-125 is needed, R-125 can enter the system line 27 through the safety valve 56 within a matter of seconds.

In order to prepare the low thermal load operation, the 2-way valve 55 is opened to allow the refrigerant in the storage tank to leave the tank. The superheated mixture vapor at 27A enters the vortex generator through 3-way valve 52. R-32 exits the vortex generator through the center outlet 62 to condenser 24 via line 32, whereas both R-125 and R-134a exit through the side outlet 63 to condenser 25 via line 33. The 3-way valve 53 sends R-32 to the storage tank 26, pushing the liquid refrigerant from the previous runs out of the storage tank. After a short period (i.e., 5–10 seconds), the 2-way valve 55 is closed, and R-32 begins to be accumulated in the storage tank 26. Consequently, the refrigerant in the system line 27 has less R-32 and more R-125 and R-134a. Accordingly, the condenser-side pressure drops and the cooling capacity at the evaporator drops. However, since the compression ratio and accordingly compressor work decrease, the EER increases. Once the new composition of the mixed refrigerant is achieved, the superheated vapor at 27A is directed to the by-pass line 30 (dotted line) with the help of the 3-way valve 52. The liquid refrigerant coming out of the condensers 24 and 25 move to the expansion valve 16 via lines 38 and 39 with the help of 3-way valves 53 and 54, respectively. The superheated vapor enters condensers 24 and 25 through the by-pass lines 34 and 35, respectively. The normal composition ratios for R-407c (a mixture of R-32, R-125 and R-134a) are 23:25:52% by weight. The new composition ratio in the invention for the low thermal load operation, for example, is 6:30:64% by weight for the low thermal load operation.

The novel concept in the invention is that a refrigeration system with a constant-speed compressor can handle variations in the thermal load. Furthermore, the system can be switched repeatedly from high to low (or from low to high) thermal load cases without turning ON and OFF the compressor. The invention reduces the energy loss due to the ON/OFF operations of the compressor, increases EER or COP of a refrigeration system, and increases heat transfer and cooling capacity when needed.

When the system is not operating, the valve 55 is opened to allow R-125 to leave the storage tank 26, thus maintaining the safety of the system. Similarly, if there is a leakage of R-32 during the operation so that the system pressure decreases below a preset value, the valve 55 is opened to allow R-125 to leave the storage tank 26, thus maintaining the safety of the system.

Figure 5:
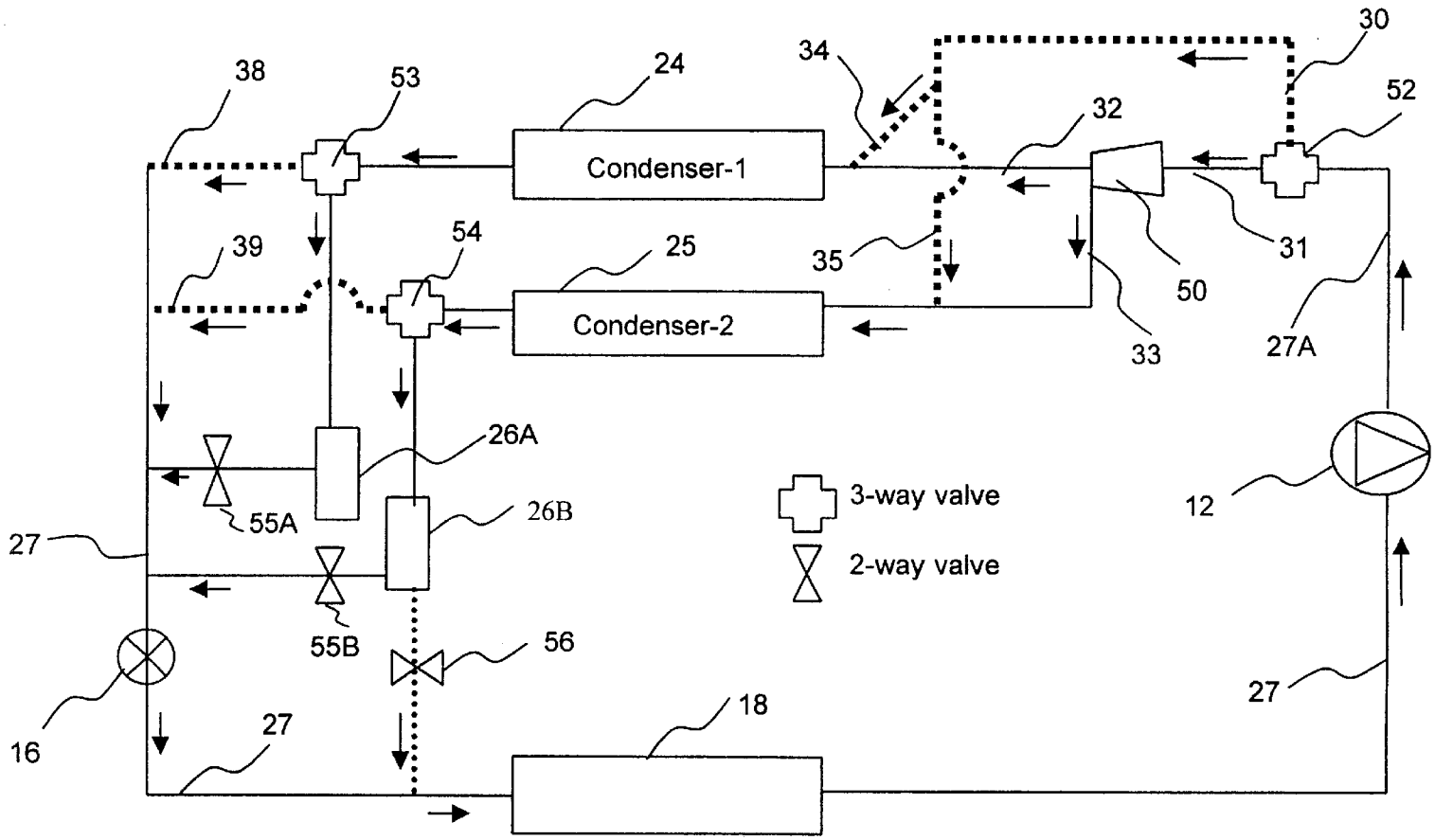
FIG. 5 shows a second embodiment of the novel refrigeration system of the present invention.

FIG. 5 shows another embodiment of the invention which uses two storage tanks 26A and 26B. Liquid R-32 is stored in storage tank 26A, whereas liquid R-125 and R-134a are stored in storage tank 26B. Valves 55A and 55B open and close as needed. The advantage of having two storage tanks is that the composition control for high and low thermal loads can be executed easily because the adjustment of R-32 can be done separately with the 3-way valve 53 and the storage tank 26A, whereas the adjustment of R-125 and R-134a can be done independently with the 3-way valve 54 and the storage tank 26B. The safety valve 56 is only used in tank 26B where R-125 is stored.

Figure 6:
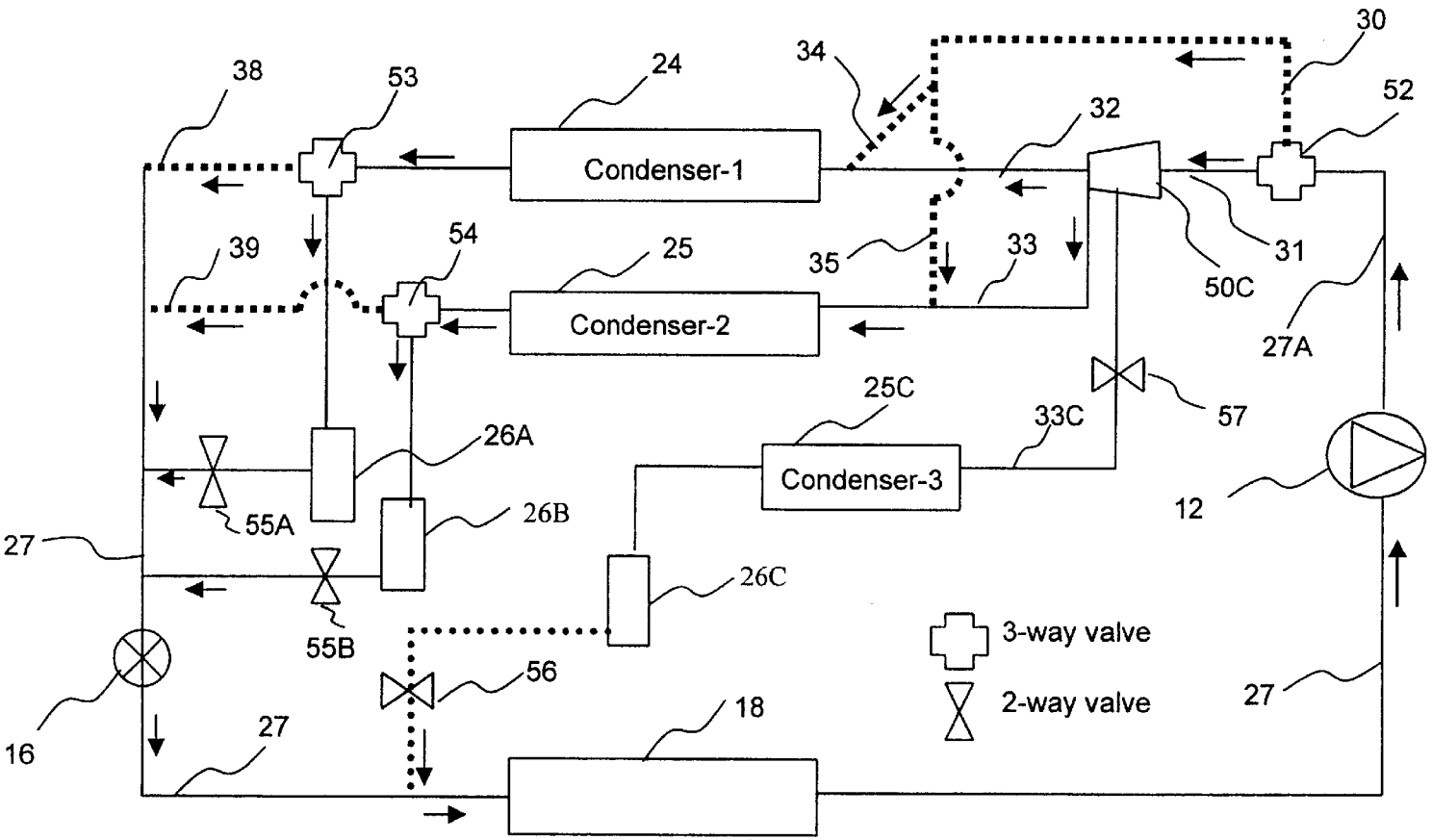
FIG. 6 shows a third embodiment of the novel refrigeration system of the present invention.
Figure 7:
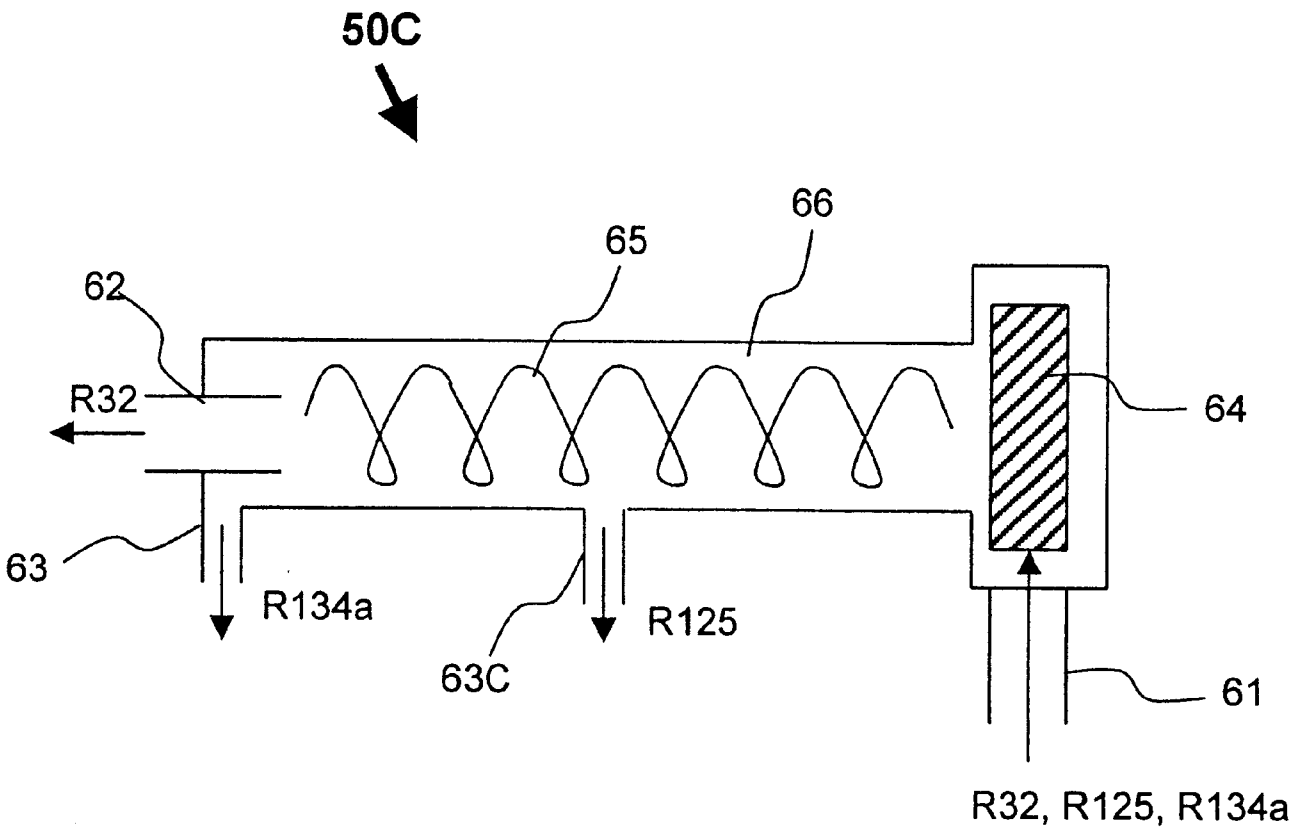
FIG. 7 shows a vortex generator suitable for use in the embodiment of the refrigeration system shown in FIG. 6.

FIG. 6 shows yet another embodiment of the invention, which uses three storage, tanks 26A, 26B, and 26C to store R-32, R-134a, and R-125, respectively. In this case, all three refrigerants can be adjusted independently. Hence, the composition control can be completely adjustable, and any combination of composition of three refrigerants is feasible. This invention uses a vortex generator, which has three outlets as shown in FIG. 7. Since R-125 vapor is about 50% heavier than R-134a vapor at a typical condenser pressure, the R-125 can be separated first and come out of the vortex generator through side outlet 63C (see FIG. 7) and enters condenser 25C via line 33C. Subsequently, the liquid R-125 enters the storage tank 26C until there is need for it. Once a desired amount of R-125 is stored in tank 26C, the valve 57 is closed to isolate the condenser 25C and storage tank 26C. Further composition control between R-32 and R-134a can be done using the vortex generator, two condensers 24 and 25, two additional storage tanks 26A and 26B as described previously.

Figure 8:
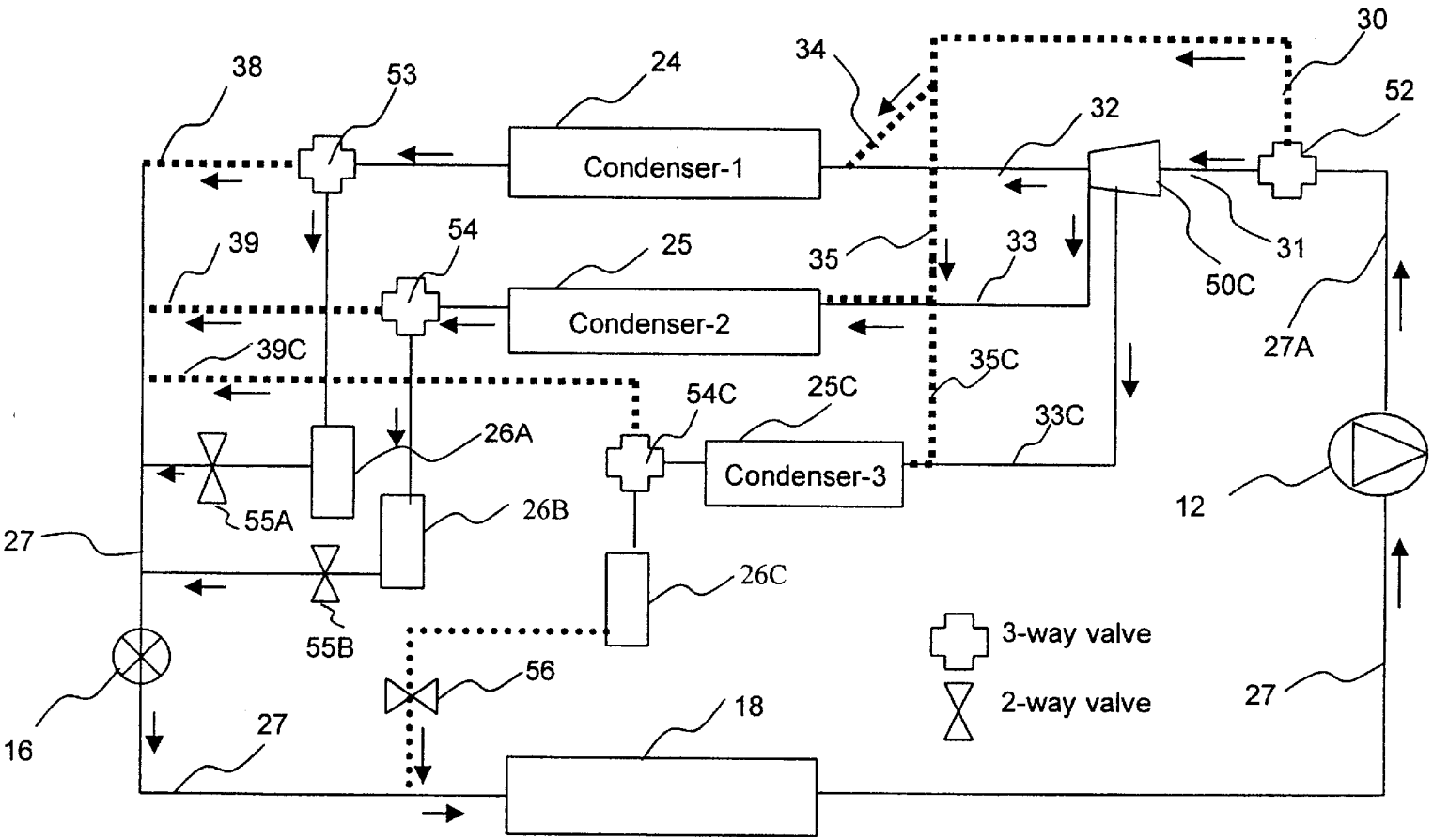
FIG. 8 shows a fourth embodiment of the novel refrigeration system of the present invention.

In the system shown in FIG. 6, the condenser 25C is used only during the composition control, but not used during cooling operation. FIG. 8 shows yet another embodiment of the invention, which overcomes the drawback of the system shown in FIG. 6. An additional 3-way valve is used between the condenser 25C and the storage tank 26C such that after the composition control is completed, the superheated refrigerant vapor flows through line 30, by-passing the vortex generator 50C, and enters three condensers 24, 25, and 25C via lines 34, 35, and 35C, respectively. For the case of the condenser 25C, the 3-way valve 54C directs refrigerant vapor to the expansion valve 16 via line 39C. Hence, the condenser 25C is continuously used for cooling operation as indicated by dotted line 39C.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A refrigeration system operable with a refrigerant mixture including components having different densities; the system comprising:

a compressor, a plurality of condensers, an expansion device, an evaporator, a separator, and a storage tank; and wherein:

an outlet of the expansion device is connected to an inlet of the evaporator;

an outlet of the evaporator is connected to an inlet of the compressor;

the separator is constructed to receive a refrigerant mixture at an inlet thereof and to provide components of the refrigerant mixture at respective outlets thereof according to the relative densities of the components;

an outlet of the compressor is selectably connectable to the inlet of the separator or to inlets of the condensers;

outlets of the condensers are selectably connectable to an inlet of the expansion device or to the storage tank; and an outlet of the storage tank is selectably connectable to the inlet of the expansion device.

2. The system of claim 1, wherein an outlet of the storage tank is selectably connectable to the inlet of the evaporator.

3. The system of claim 2, further including a compressor outlet valve operable to selectably provide a refrigerant flow path from an outlet of the compressor to an inlet of the separator or from the compressor outlet directly to the condensers.

4. The system of claim 3, further including first and second condenser outlet valves operable to selectably provide refrigerant flow paths from respective outlets of the condensers to inlets of the storage tank, or from the condenser outlets directly to the expansion device.

5. The system of claim 4, further including a first storage tank outlet valve operable to selectably provide a refrigerant flow path from the storage tank to the inlet of expansion device.

6. The system of claim 5, further including a second storage tank outlet valve operable to selectably provide a refrigerant flow path from the storage tank to the inlet of the evaporator.

7. The system of claim 1, further including first and second condenser outlet valves operable to selectably provide refrigerant flow paths from respective outlets of the condensers to inlets of the storage tank, or from the condenser outlets directly to the expansion device.

8. The system of claim 7, further including a first storage tank outlet valve operable to selectably provide a refrigerant flow path from the storage tank to the inlet of expansion device.

9. The system of claim 8, further including a second storage tank outlet valve operable to selectably provide a refrigerant flow path from the storage tank to the inlet of the evaporator.

10. The system of claim 1, further including a first storage tank outlet valve operable to selectably provide a refrigerant flow path from the storage tank to the inlet of expansion device.

11. The system of claim 10, further including a second storage tank outlet valve operable to selectably provide a refrigerant flow path from the storage tank to the inlet of the evaporator.

12. The system of claim 1, wherein the compressor is operated continuously at a constant speed when the system is in use, irrespective of variations in thermal load.

13. the refrigeration system of claim 1, further comprising multiple storage tanks, including a storage tank associated with each condenser, and wherein:

an outlet of each condenser is selectably connectable to an inlet of the expansion device or to a respective inlet of the associated second storage tank; and outlets of the storage tanks are selectably connectable to the inlet of the expansion device.

14. The system of claim 13, wherein an outlet of one of the storage tanks is selectably connectable to the inlet of the evaporator.

15. The system of claim 13, further including a plurality of condenser outlet valves operable to selectably provide refrigerant flow paths from respective outlets of the condensers to respective inlets of the associated storage tanks, or from the condenser outlets directly to the inlet of the expansion device.

16. The system of claim 15, further including:

a plurality of storage tank outlet valves operable to selectably provide refrigerant flow paths from respective outlets of the storage tanks to the inlet of the expansion device.

17. The system of claim 16, further including an additional storage tank outlet valve operable to selectably provide a refrigerant flow path from an outlet of one of the storage tanks to the inlet of the evaporator.

18. The system of claim 13, further including:

a plurality of storage tanks outlet valves operable to selectably provide refrigerant flow paths from respective outlets of the storage tanks to the inlet of the expansion device.

19. The system of claim 18, further including an additional storage tank outlet valve operable to selectably provide a refrigerant flow path from an outlet of one of the storage tanks to the inlet of the evaporator.

20. The system of claim 13, wherein the compressor is operated continuously at a constant speed when the system is in use, irrespective of variations in thermal load.

21. The system of claim 13, further comprising:

an additional condenser and an associated additional storage tank, the additional condenser and the additional storage tank being operable to selectably provide a refrigerant flow path between an outlet of the separator and the inlet of the evaporator.

22. The system of claim 21, further including an inlet valve connecting the separator and an inlet of the additional condenser; and an outlet valve between an outlet of the additional storage tank and the inlet of the evaporator.

23. The system of claim 13, further comprising:

an additional condenser and an associated additional storage tank having an outlet selectably connectable to the inlet of the evaporator, and wherein an outlet of the additional condenser is selectably connectable to provide a refrigerant flow path between an outlet of the additional condenser and the inlet of the evaporator or between the outlet of the additional condenser and an inlet of the additional storage tank.

24. The system of claim 23, further comprising:

a compressor outlet valve operable to selectably provide a refrigerant flow path from an outlet of the compressor to an inlet of the separator or from the compressor outlet directly to inlets of all the condensers.

25. The system of claim 23, wherein the compressor is operated continuously at a constant speed when the system is in use, irrespective of variations in thermal load.

26. The system of claim 13, further comprising:

a compressor outlet valve operable to selectably provide an refrigerant flow path from an outlet of the compressor to an inlet of the separator or from the compressor outlet directly to all the condensers.

27. A method of operating a refrigeration system of the type which uses a refrigerant mixture including components having different densities; and which is comprised of a compressor, a plurality of condensers, an expansion device, and an evaporator, the compressor, all connectable in a closed path for circulation of refrigerant, a separator constructed to receive a refrigerant mixture at an inlet thereof and to provide components of the refrigerant mixture at respective outlets thereof according to the relative densities of the components, and a storage tank, the method being comprised of the steps of:

connecting the compressor, the separator, and the condensers to deliver a selected refrigerant component to the closed path, and to deliver the remaining refrigerant components to the storage tank for a first storage time interval; and after the first storage time interval:

preventing delivery of further refrigerant to the storage tank; and circulating the unstored refrigerant through the closed path, the components selected for circulation and storage during the first storage time interval, and the duration of the first storage time interval being selected according to the thermal load.

28. The method of claim 26, wherein, upon a predetermined change in thermal load, the composition of the refrigerant circulating through the second closed flow path is adjusted by the steps of:

connecting the compressor, the separator, and the condensers to deliver another selected refrigerant component to the closed path, and to deliver the remaining refrigerant components to the storage tank for a second storage time interval; and after the second storage time interval, preventing delivery of further refrigerant to the storage tank; and circulating the unstored refrigerant through the closed path, the components selected for circulation and storage during the second storage time interval, and the duration of the second storage time interval being selected according to the change in thermal load.

29. The method of claim 26, further including, for an initial time interval, the steps of:

connecting the storage tank to the closed path to permit refrigerant to flow out of the tank; and thereafter, disconnecting the tank from the closed path to allow accumulation therein of refrigerant during the first storage time interval.

30. The method of claim 26, wherein the compressor is operated continuously at a fixed speed when the system is in use, irrespective of variations in the thermal load.

31. The method of claim 26, wherein the refrigeration system is of the type which is further comprised of additional storage tanks, including a storage tank associated with each condenser, the method being further comprised of the steps of:

connecting the compressor, the separator, and the condensers to deliver a selected refrigerant component to the closed path, and to deliver the remaining refrigerant components to the storage tanks separated according to the relative densities thereof for a plurality of storage time intervals respectively;

preventing delivery of further refrigerant to each the storage tanks after the respective storage time interval; and thereafter, circulating the unstored refrigerant through the closed path, the components selected for circulation and storage during the respective storage time intervals, and the duration of the storage time intervals being selected according to the thermal load.

32. The method of claim 31, wherein, upon a predetermined change in thermal load, the composition of the refrigerant circulating through the second closed flow path is adjusted by the steps of:

connecting the compressor, the separator, and the condensers to deliver another selected refrigerant component to the closed path, and to deliver the remaining refrigerant components separated according to density, to the storage tanks for a plurality of further storage time intervals; and after the plurality of further storage time intervals, preventing delivery of further refrigerant to the storage tank; and circulating the unstored refrigerant through the closed path, the components selected for circulation and storage during the plurality of further storage time intervals, and the duration of the plurality of further storage time intervals being selected according to the change in thermal load.

33. The method of claim 31, further including, for an initial time interval, the steps of:

connecting the storage tanks to the closed path to permit refrigerant stored in the storage tanks to flow out of the tanks; and thereafter, disconnecting the tanks from the closed path to allow accumulation therein of refrigerant during the further storage time intervals.

34. The method of claim 32, wherein the compressor is operated continuously at a fixed speed when the system is in use, irrespective of variations in the thermal load.

35. A refrigeration system operable with a refrigerant mixture including components having different densities; the system comprising:

a compressor;

a plurality of condensers, an expansion device;

an evaporator, the compressor, the condensers, the expansion device, and the evaporator being connectable in a closed path for circulation of refrigerant;

a separator constructed to receive a refrigerant mixture at an inlet thereof and to provide components of the refrigerant mixture at respective outlets thereof according to the relative densities of the components; and a storage tank, the separator and the storage tank being selectably connectable with the compressor, the condensers, the storage tank and the closed path to store one or more separated components of the refrigerant mixture in the storage tank, thereby controlling the composition of the refrigerant being circulated in the closed path.

36. The system of claim 35, wherein the separator is a vortex generator.

37. The system of claim 34, wherein the vortex generator produces centrifugal force large enough to separate refrigerant vapor components whose densities are substantially different.

38. The system of claim 35, wherein said the refrigerant mixture is R-32, R-125 and R-134a.

39. The system of claim 33, further comprising additional storage tanks, including a storage tank associated with each condenser, the condensers and the associated storage tanks and the separator being selectably connectable with the compressor, and the closed path to store one or more separated components of the refrigerant mixture in the storage tanks, separated according to the relative density of the components thereby controlling the composition of the refrigerant being circulated in the closed path.

* * * * *